United States Patent [19]

Miltz

[11] Patent Number: 4,838,256

[45] Date of Patent: Jun. 13, 1989

[54] METHOD AND APPARATUS FOR AIR TRANSFER BETWEEN SCUBA DIVERS

[76] Inventor: Arthur I. Miltz, 212 Mayhew Dr., South Orange, N.J. 07079

[21] Appl. No.: 187,556

[22] Filed: Apr. 28, 1988

[51] Int. Cl.[4] ..... A62B 9/04; A62B 7/00

[52] U.S. Cl. ..... 128/202.27; 128/204.18; 128/205.24

[58] Field of Search ..... 128/201.11, 201.27, 128/207.12, 207.16, 202.27, 201.21, 201.28, 202.14, 200.24, 201.23, 201.24, 204.18, 202.22, 205.24, 205.28, 204.28, 204.26

[56] References Cited

U.S. PATENT DOCUMENTS

| | | | |
|---|---|---|---|
| 2,406,888 | 9/1946 | Meidenbauer, Jr. | 128/205.24 |
| 2,453,475 | 11/1948 | Jobias | 128/202.27 |
| 2,764,151 | 9/1956 | Cupp | 128/202.22 |
| 2,854,001 | 9/1958 | Humblet | 128/202.27 |
| 3,238,943 | 3/1966 | Holley | 128/202.27 |
| 3,433,222 | 3/1969 | Pinto | 128/202.27 |
| 3,575,167 | 4/1971 | Michielson | 128/205.28 |
| 3,995,626 | 12/1976 | Pearce, Jr. | 128/204.18 |
| 4,111,342 | 9/1978 | Kirby | 128/200.24 |
| 4,274,411 | 6/1981 | Dotson, Jr. | 128/910 |
| 4,392,490 | 7/1983 | Mattingly et al. | 128/204.18 |
| 4,449,524 | 5/1984 | Gray | 128/205.24 |
| 4,714,077 | 12/1987 | Lambert | 128/204.18 |

*Primary Examiner*—Edgar S. Burr
*Assistant Examiner*—Kimberly L. Asher
*Attorney, Agent, or Firm*—Myron Amer

[57] ABSTRACT

In scuba diving, an underwater method of transferring air from donor to donee tank supplies using an interconnecting air transfer hose and an air bubble signal to signify that the air transfer hose is cleared of any water therein and in condition to be used for transferring air.

5 Claims, 2 Drawing Sheets

METHOD AND APPARATUS FOR AIR TRANSFER BETWEEN SCUBA DIVERS

Figure 1:
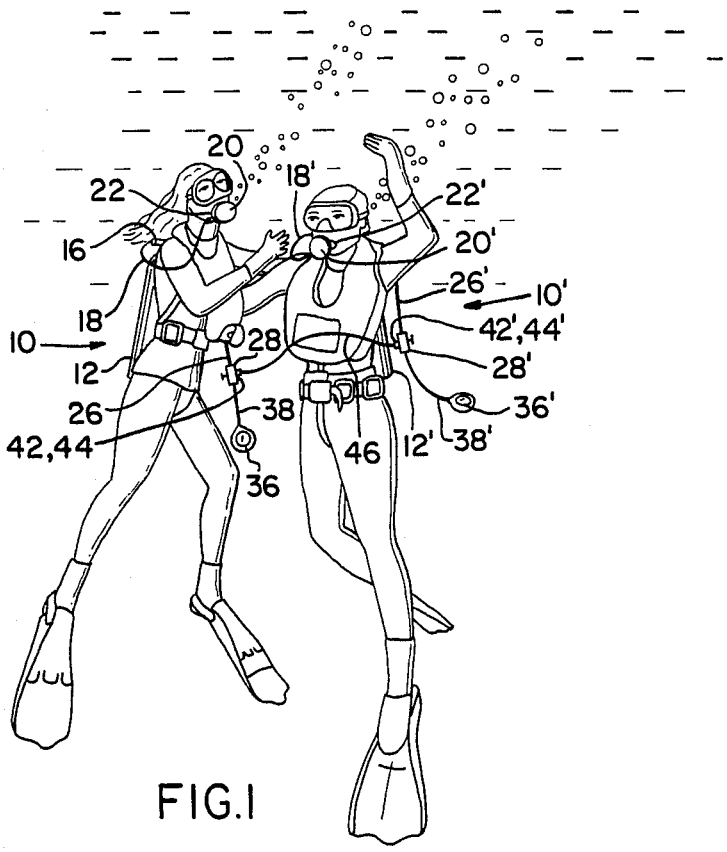
Figure 2:
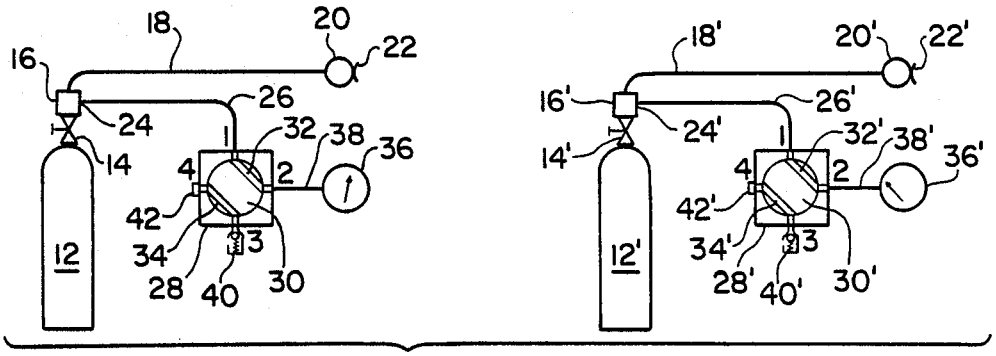

The present invention relates generally to improvements for Self-Contained Underwater Breathing Apparatus, more popularly known by the acronym SCUBA, and more particularly to a procedure and equipment by which air can be effectively and safely transferred while under water from one tank to another, as distinguised from the prior art practice in which one diver (the donor) can only merely allow a second driver (the donee) to share or use the air supply of the donor.

THE PRIOR ART

In the early 1940's, Emile Gagnon and Jacques Costeau developed under water diving gear that has undergone very little change since that time. At first, known as the Aqualung, the Self-Contained Underwater Breathing Apparatus has taken on the acronym SCUBA. The current most popular form of scuba diving equipment employs a compressed air storage tank (or tanks) wth a simple on-off valve known as a "K" valve. Attached to this valve is a first stage regulator which reduces air from tank pressure (about 2500 p.s.i. at full charge) to about 100 p.s.i. over ambient pressure. A single flexible hose carries this air to the second stage regulator where it is reduced to ambient pressure. At this point, the user's air enters a mouthpiece where it is utilized on a demand basis.

Many factors determine the rate at which the air in the diver's storage tank is used. Such things as water temperature, diver activity and at what water depth the diver swims influence how much tank air remains available to the user.

When "buddes" go diving, it is rare that they will consume tank air at the same rate and there comes a time during the dive when one partner runs low on air for one reason or another. At this point, both divers must curtail their activity and surface. It is an object of this invention to provide a simple and safe way to transfer part of the excess air to the "near empty" tank while at dive depth. By achieving a transfer of some of the remaining air, the diving partners can continue the dive until most air from both their tanks is substantially used.

EXAMPLES OF THE PRIOR ART

U.S. Pat. No. 4,449,524 issued on May 22, 1984 to Gray, and U.S. Pat. No. 3,995,626 issued on Dec. 7, 1976 to Pearce both show typical methods and devices used by two divers in which one diver is able to allow a second diver to share a remaining air supply, but neither of these or any other known patent discloses any methods or devices by which two divers can equalize the air content of their respective tanks.

It is thus desirable to have, and herewith provided in accordance with the present invention a method and equipment for practicing said method, in which air can be transferred under water from one tank to another tank. It, moreover, is an object that the under wter air transfer be effective and safe, in which the safety contemplates that the method steps be readily initiated by the donor and donee divers and that they be carried out totally under their effective supervision. As only some examples, and as will be explained in greater detail subsequently, at the start of the ir transfer, the donee is provided with a visual signal consisting of under water bubbling, and during the actual transfer both divers have an audible signal in the form of a flow sound through the interconnecting hoses. Moreover, not only does the "bubbling" just referred to provide a visual signal to the divers that the air transfer through a hose connecting the respective tanks of the divers is proceeding as intended, but it clears the interconnecting hose between the tanks of any water that might unavoidably have entered therein while the interconnection between the tanks was being made, or been there prior thereto.

Also to be noted, the method herein which actually results in air transfer from the tank of the donor to the tank of the donee enables these divers, after the transfer, to continue their separate diving activities. This is significantly in contrast to the prior art practice in which one diver can share the air supply of another diver but in doing so must, of course, remain connected to said air supply.

The description of the invention which follows, together with the accompanying drawings, should not be construed as limiting the invention to the example shown and described, because those skilled in the art to which this invention appertains will be able to devise other forms thereof within the ambit of the appended claims.

Figure 7:
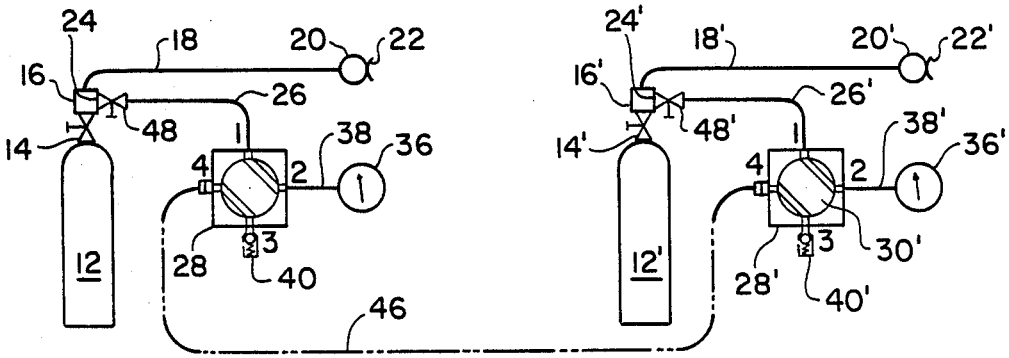

FIG. 1 is a perspective view illustrating two scuba divers, one a donor and one a donee, transferring tank air under water in accordance with the present invention;

FIG. 2–6, inclusive, are schematic views of the apparatus for practicing the within inventive method, said views illustrating in sequence the steps of said method; and FIG. 7 is an additional schematic view of the apparatus to which additional components, i.e. cutoff valves (48, 48') have been added.

In FIG. 1 is shown a pair of "buddy" scuba divers. Since each wears similar equipment, but one (the donor) is to transfer air to the other (the donee), identical reference numbers will be used throughout the figures for both sets of equipment, except the numbers used for the donee's equipment will be primed.

In FIGS. 1–6, in addition to the usual swim fins, weight belt, buoyancy compensator, etc., it is shown that each of the divers 10 (10') will carry a compressed air storage tank 12 (12') secured with a suitable harness and fitted with an on-off valve 14 (see FIGS. 2–7). Connected to valve 14 is a first stage regulator 16 which supplies air to second stage regulator 20 via a flexible hose 18. Within regulator 20, air is reduced to ambient pressure. That is, pressure equl to the pressure that exists at the level at which the diver 10 happens to be. Regulator 20 is fitted with a mouthpiece 22 through which diver 10 breathes while under water.

Regulator 16 is also provided with a high pressure port 24 to which hose 26 is connected. Prior art practice provides for hose 26 to be continuous with hose 38 leading to a pressure gauge 36 which normally indicates air pressure in tank 12 when valve 14 is open and regulator 16 is in place.

To accomplish under water air transfer from tank 12 to tank 12', a plug valve 28 (28') has been installed between hoses 26 and 38. Valve 28 has four ports shown in FIGS. 2–7 and numbered clockwise therein 1, 2, 3 and 4. Port 1 is connected directly to tank 12 via port 24 and hose 26. Port 2 is connected to pressure gauge 36 via hose 38. Port 3 is fitted with a spring biased check valve 40 which allows only for flow away or in any exiting direction from valve 28. Port 4 is fitted with a quick disconnect coupling means 42 so as to connect with like connectors, 44, 44' on hose 46 (FIGS. 3, 4, 5 and 7). It is preferred that coupling means 42, 44 be of hermaphrodite configuration, so that a quick connection between two ports 4 (42 to 42') can be made without hose 46, should it be necessary to do so. Hose 46 is carried by at least one of the pair of divers 10, 10' as auxiliary equipment.

Within valve 28 is a plug 30 with throughbores 32 and 34. Plug 30 can be rotated 90° clockwise from the position shown in FIG. 2 and then rturned. Indexing stop means (not shown) are provided to indicate the position of plug 30 within valve 28.

Before divers 10, 10' start their dive, valve 14 will be open and regulators 16 and 20 will deliver air on demand at mouthpiece 22. Plug 30 within valve 28 is positioned for throughbore 32 to register air pressure within tank 12 on gauge 36. As the dive progresses, the divers 10, 10' monitor the air remaining in their respective tanks and compare with each other. As shown for illustrative purposes in FIG. 2, a point is reached when pressure gauge 36' shows an "almost empty" condition in tank 12' while pressure gauge 36 shows a considerable remainder in tank 12. Through hand signals or slateboard communication, an air transfer from donor tank 12 to donee tank 12' is arranged. As in the buddy breathing procedure, the donor 10 is in charge of the air transfer procedure.

Figure 3:
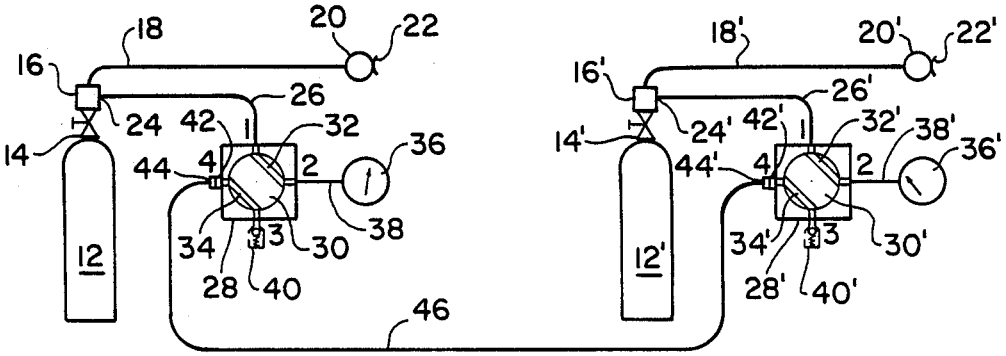

FIG. 3 shows hose 46 with connectors 44, 44' connected to connectors 42, 42'. Thus, a continuous passage is established between ports 4 of valves 28, 28'. Divers 10, 10' continue to breath through their respective mouthpieces 22, 22'.

Figure 4:
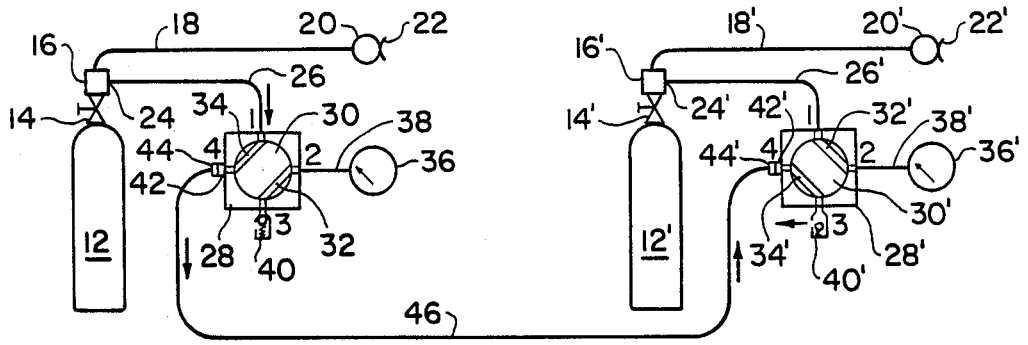
Figure 5:
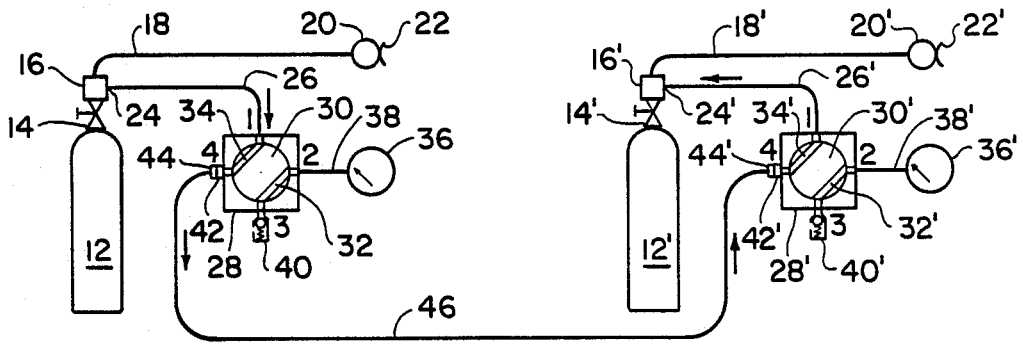
Figure 6:
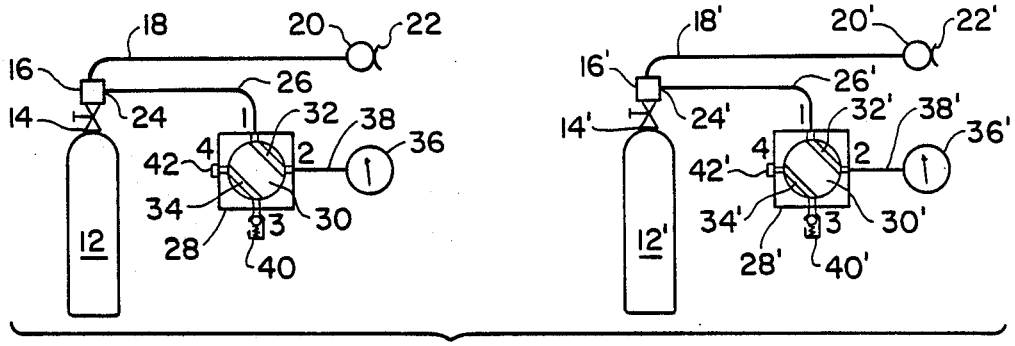

In FIG. 4, diver 10 has rotated plug 30 of valve 28, 90° counterclockwise so that bore 34 aligns with ports 1 and 4 of valve 28. Air from tank 12 is now free to flow into port 1 and out port 4 of valve 28, through hose 46, into port 4 and out port 3 of valve 28'. When bubbles appear at check vlve 40', diver 10' achieves the arrangement of FIG. 5 wherein he rotates plug 30', 90° counterclockwise and now air from tank 12 passes through valve 14, port 24, hose 26, throughbore 34, hose 46, throughbore 34', hose 26', port 24', valve 14', into tank 12'. Note in FIG. 5 that pressure gauges 36, 36' will indicate ambient pressure or less. Any high pressure air that was within the gauge 36, 36' and its connections is vented through check valves 40, 40'. It has been found in practice that the passage of air from tank 12 to tank 12' is audible and thus when pressure is equal in both tanks, no further flow sound will be heard.

At this point, valves 28, 28' are rotated 90° counterclockwise and hose 46 can be disconnected. Both pressure gauges 36, 36' will now show a pressure reading that is approximately an average of those pressures observed in FIG. 2. both divers can now continue on their dive.

In FIG. 7 is shown an alternte embodiment which is identical to that already described except that quick acting cutof valves 48, 48' have been added to the equipment to isolate the air transfer circuit should any difficulty arise.

Prior to diving, one diver may be "low" on air supply. Thus, it is within the scope of the invention to make an above water air transfer by conducting the procedure as described.

While the particular diving apparatus and method herein shown and disclosed in detail is fully capable of attaining the objects and providing the advantages hereinbefore stated, it is to be understood that it is merely illustrative of the presently preferred embodiment of the invention and that no limitations are intended to the detail of construction or design herein shown other than as defined in the appended claims.

What is claimed is:

1. In scuba diving, an underwater method of transferring air from donor to donee tank supplies wherein said donor air supply is normally connected to a donor control valve having at least an air supply port and an air transfer outlet port and said donee tank air supply is normally connected to a donee control valve having at least an air supply port, an air transfer inlet port, and an air bubble signal port, said method comprising the steps of connecting said donor and said donee air supplies to said respective control valve air supply ports so as to allow the monitoring of the contents of said tank air supplies during an underwater dive, arranging in said donee control valve for communication of the air transfer inlet port thereof to said air bubble signal port thereof preparatory to providing an air bubble signal using air exiting from said air bubble signal port, connecting opposite ends of an air transfer hose between said donor control valve air transfer outlet port and said donee control valve air transfer inlet port for establishing air flow communication therebetween, arranging in said donor control valve for communication of the air supply port thereof to said air transfer outlet port thereof to thereby cause air from said donor tank air supply to flow through the previously connected air transfer hose and exit from said donee control valve air bubble signal port to clear said air transfer hose of any water located therein, and then to provide an air bubble signal of completion of said clearing step to said divers, and disconnecting the connection of said donee control valve air transfer inlet port to said air bubble signal valve and in lieu thereof establishing communication of said donee air transfer inlet port to said donee air supply port while maintaining air flow into said transfer hose, whereby said air from said donor tank air supply previously providing said air bubble signal is instead allowed to flow into said donee air supply and thereby replenish said air supply of said tank without the entry of water into said air supply.

2. The method of transferring air while scuba diving as claimed in claim 1 wherein said control valves of said donor and donee each have a fourth port and including connecting a hose from each said fourth port to a pressure gauge for allowing said monitoring of the content of said donor and donee tank supplies by visual observation of the pressures of said pressure gauges.

3. The method of transferring air while scuba diving as claimed in claim 2 wherein sach said donor and donee control valve has a rotatable central core and has said four ports thereof in circumferentially spaced relation thereabout, and including rotating said central core to selectively establish communication to and between said ports.

4. Apparatus for practicing the method of transferring air while scuba diving as claimed in claim 1 comprising for each said donor and donee scuba diver a four way valve with a rotatable central core having four ports in circumferentially spaced relation thereabout, a pair of hoses respectively connected from the tank air supplies of said divers to a first selected port of said control valves and from a second selected port to a pressure gauge for monitoring the content of said tank air supplies, and an air transfer hose for interconnecting other selected ports of said control valves incident to allowing air to be transferred from the donor tank air supply to the donee air supply.

5. Apparatus for transferring air while scuba diving as claimed in claim 4, including on the opposite ends of said air transfer hose and said pair of hoses and in said ports of said control valves plural cooperating quick connect and disconnect means, to thereby facilitate the establishing of the connections between said hoses and ports.

* * * * *